US011241633B2

(12) United States Patent
Bloomfield et al.

(10) Patent No.: US 11,241,633 B2
(45) Date of Patent: Feb. 8, 2022

(54) HYBRID RIDE VEHICLE SYSTEMS AND METHODS

(71) Applicant: Universal City Studios LLC, Universal City, CA (US)

(72) Inventors: Andrew Evan Bloomfield, Windermere, FL (US); Kevin Blaine Primm, Orlando, FL (US); Michael Keith Brister, Winter Garden, FL (US); Eric Vance, Ocoee, FL (US); Ryan Dale Walton, Orlando, FL (US)

(73) Assignee: Universal City Studios LLC, Universal City, CA (US)

( * ) Notice: Subject to any disclaimer, the term of this patent is extended or adjusted under 35 U.S.C. 154(b) by 401 days.

(21) Appl. No.: 16/282,140

(22) Filed: Feb. 21, 2019

(65) Prior Publication Data

US 2020/0108324 A1 Apr. 9, 2020

Related U.S. Application Data

(60) Provisional application No. 62/742,124, filed on Oct. 5, 2018.

(51) Int. Cl.

| | |
|---|---|
| ***A63G 21/20*** | (2006.01) |
| ***A63G 21/18*** | (2006.01) |
| ***A63G 21/12*** | (2006.01) |
| ***A63G 31/12*** | (2006.01) |
| ***A63G 31/00*** | (2006.01) |

(52) U.S. Cl.

CPC ..... *A63G 21/20* (2013.01); *A63G 21/12* (2013.01); *A63G 21/18* (2013.01); *A63G 31/007* (2013.01); *A63G 31/12* (2013.01)

(58) Field of Classification Search

CPC ..... A63G 3/00; A63G 31/00; A63G 31/007; A63G 21/08; A63G 21/18; A63G 25/00; A63G 21/20

USPC ..... 472/43, 128–129; 104/53, 73

See application file for complete search history.

(56) References Cited

U.S. PATENT DOCUMENTS

| | | | | |
|---|---|---|---|---|
| 5,704,294 | A * | 1/1998 | Van Winkle | A63C 19/00 104/60 |
| 6,810,817 | B1 | 11/2004 | James | |
| 8,079,916 | B2 | 12/2011 | Henry | |
| 8,091,483 | B1 * | 1/2012 | Sumner | A63G 3/00 104/73 |
| 8,393,275 | B2 | 3/2013 | Jacobi et al. | |
| 8,453,579 | B2 * | 6/2013 | Nemeth | A63G 3/00 104/53 |

(Continued)

FOREIGN PATENT DOCUMENTS

| | | |
|---|---|---|
| NL | 1009494 | 1/2000 |

OTHER PUBLICATIONS

PCT/US2019/054506 International Search Report and Written Opinion dated Jan. 28, 2020.

*Primary Examiner* — Kien T Nguyen

(74) *Attorney, Agent, or Firm* — Fletcher Yoder P.C.

(57) ABSTRACT

An amusement park system in accordance with present embodiments includes a ride vehicle configured to move along a path, an aquatic portion of the path defined by a water flow path, and an aerial portion of the path defined by a track configured to support a bogie. The ride vehicle is configured to freely float and move along the water flow path in response to currents of the water flow path. The ride vehicle is configured to be carried along the track by the bogie.

23 Claims, 9 Drawing Sheets

(56) References Cited

U.S. PATENT DOCUMENTS

| | | | | |
|---|---|---|---|---|
| 8,931,417 | B2 * | 1/2015 | Shasha | A63G 31/16 104/91 |
| 2009/0193997 | A1 | 8/2009 | Payne | |
| 2010/0160054 | A1 | 6/2010 | Henry | |

* cited by examiner

HYBRID RIDE VEHICLE SYSTEMS AND METHODS

CROSS-REFERENCE TO RELATED APPLICATION

This application claims priority to and the benefit of U.S. Provisional Application No. 62/742,124, entitled "HYBRID RIDE VEHICLE SYSTEMS AND METHODS," filed Oct. 5, 2018, which is hereby incorporated by reference in its entirety for all purposes.

BACKGROUND

The present disclosure relates generally to the field of amusement parks. More specifically, embodiments of the present disclosure relate to methods and equipment used in conjunction with amusement park rides.

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Since the early twentieth century, amusement parks (or theme parks) have substantially grown in popularity. Certain amusement park rides may include a water ride configured to carry users only along a water path. Other amusement park rides may include a roller coaster ride configured to carry users only along a track with a bogie. However, such narrow riding formats may serve to limit an experience of a user. Accordingly, it is now recognized that an improved amusement park ride having multiple transportation modes may be desirable to enhance guest experience.

SUMMARY

Certain embodiments commensurate in scope with the originally claimed subject matter are summarized below. These embodiments are not intended to limit the scope of the disclosure, but rather these embodiments are intended only to provide a brief summary of certain disclosed embodiments. Indeed, the present disclosure may encompass a variety of forms that may be similar to or different from the embodiments set forth below.

In accordance with one embodiment, an amusement park system includes a ride vehicle configured to move along a path, an aquatic portion of the path defined by a water flow path, and an aerial portion of the path defined by a track configured to support a bogie. The ride vehicle is configured to freely float and move along the water flow path in response to currents of the water flow path. The ride vehicle is configured to be carried along the track by the bogie.

In another embodiment, a ride vehicle system includes a ride vehicle having a slot disposed internal to a hull of the ride vehicle and configured to freely float on a liquid along a flow path. The ride vehicle system further includes bogie configured to move along a track and to couple to the ride vehicle via the slot.

In a further embodiment, an amusement park system includes a ride vehicle configured to travel along a geographic path. The amusement park system further includes a bogie configured to travel along a track, engage with the ride vehicle, carry the ride vehicle along the track, and disengage from the ride vehicle.

DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

The present disclosure provides, among other things, embodiments of a ride system having both an aquatic ride portion and an aerial ride portion (e.g., multiple modes of transportation). For example, the ride system may include a ride vehicle configured to function as both a boat to float along a water flow path of the aquatic portion and configured to function as a roller coaster to move along an aerial track of the aerial portion. Generally, amusement parks may include ride attractions having a boat configured to float along a waterway. Amusement parks may also include separate ride attractions having a coaster configured to move along a track. However, the singular and sometimes predictable ride formats of these attractions serve to limit the experience of the user. Some amusement park rides aim to solve this problem by utilizing a ride vehicle that moves along a track where the track may include an aerial portion and a submerged portion. However, simply transitioning from between an aerial track and a submerged track still provides a limited experience. Indeed, since the ride vehicle is confined to the submerged track while in the water portion, the user does not experience the full buoyed floating effect associated with being in an actual boat. In reality, the result is simply a slow and predictable roller coaster that may be in contact with water. Accordingly, provided herein is a hybrid ride attraction that includes one or more transitions between riding formats. In certain embodiments, each riding format may be separate and distinct such that the transition between riding formats is unexpected. Indeed, the transition between riding formats serves to surprise and increase a level of entertainment of the user.

Particularly, embodiments of the present disclosure include a ride vehicle configured to freely float on water and to couple to a ride track via an engagement assembly (e.g., prongs, a forklift) extending from a bogie. While the ride vehicle is floating on the water portion of the ride, the users may be unaware of the upcoming change in ride format. Indeed, the ride vehicle may appear to the users as purely a boat not capable of transitioning to an aerial ride format. Once the ride vehicle couples to the bogie, the bogie may carry the ride vehicle along the ride track while pitching, yawing, and/or rolling the ride vehicle, thereby further enhancing a thrill factor for the users.

Figure 1:
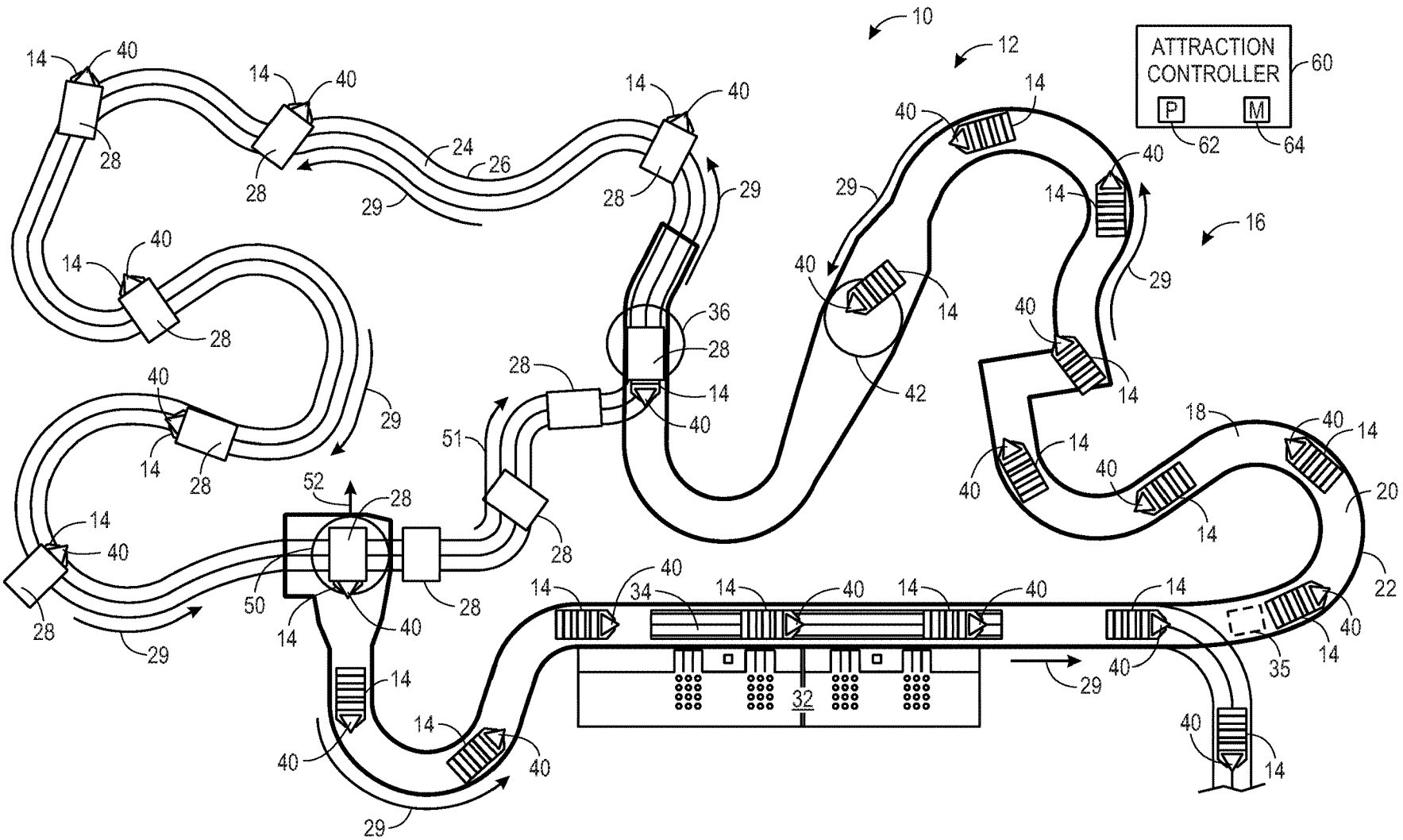
FIG. 1 is an schematic view of an embodiment of a ride attraction, in accordance with the present disclosure.

With the foregoing in mind, FIG. 1 illustrates a ride system 10 (e.g., amusement park attraction) of an amusement park 12. The ride system 10 includes multiple ride vehicles 14 configured to move along a path 16 of the ride system 10. The path 16 includes an aquatic portion 18 having a flow path 20 defined by a flume 22. The path 16 also includes an aerial portion 24 defined by a track 26. As discussed herein, the ride vehicles 14 are configured to both freely float along the aquatic portion 18 and to be carried by a bogie 28 along the aerial portion 24 in a direction as indicated by arrows 29. As the ride vehicles 14 travel along the path 16, the ride vehicles 14 may be subjected to various thematic effects, such as animatronic show pieces, special effects, and so forth.

To illustrate, at the start of a ride cycle, users may board and disembark the ride vehicle 14 from a boarding platform 32. In some embodiments, while the users board/disembark the ride vehicle 14 from the boarding platform 32, the ride vehicle 14 may be supported by a conveyer 34 disposed adjacent to the boarding platform 32. The conveyer 34 may move the ride vehicles 14 in front of the boarding platform 32 at a consistent speed and elevation to allow users to easily board the ride vehicles 14. In some embodiments, the conveyer 34 may cause the ride vehicles 14 to momentarily stop in front of the boarding platform 32 to allow the users to board the ride vehicles 14. In some embodiments, the conveyer 34 may be partially submerged or completely submerged under water of the flow path 20.

Once the users have boarded the ride vehicle 14, the conveyer 34 may translate the ride vehicle 14 to a position downstream of the conveyer 34, relative to a flow direction of the flow path 20 in the aquatic portion 18, as indicated by the arrows 29. The ride vehicle 14 may then freely float along the length of the aquatic portion 18. That is, in certain embodiments, movement of the ride vehicle 14 may be controlled by a current of the flow path 20. In other words, ride vehicle 14 may not include any elements/features that are used to couple any elements disposed within the aquatic portion 18 to motivate the ride vehicle 14 along the aquatic portion 18. Indeed, aside from the conveyer 34, the aquatic portion 18 may not include any mechanical elements to motivate the ride vehicle 14 along the flow path 20. For example, the water current used to motivate the ride vehicle 14 along the path 16 may be caused by a slope in the flume 22 and/or by a mechanical propulsion system 35, such as water jets or propellers disposed along the flow path 20. While illustrated at a particular point along the path 16, it is to be understood that the propulsion system 35 may be disposed throughout the aquatic portion 18 of the path 16. Generally, the motion of the ride vehicle 14 while in the aquatic portion 18 may be a direct result of ripples, waves, currents, and so forth of the flow path 20. This may result in random, unpredictable movements of the ride vehicle 14, similar to a traditional movement of a boat on water, thereby enhancing a thrill factor for the users. Indeed, unlike traditional water based rides where a track is present under water, in certain embodiments, the ride vehicle 14 is supported only by its buoyancy in the water of the aquatic portion 18.

The ride vehicle 14 may generally travel along at least a portion of the flow path 20, as indicated by the arrow 29, with a front 40 of the ride vehicle 14 generally facing in the downstream direction of the flow path 20. In certain embodiments, the ride vehicle 14 may sway (e.g., yaw) to some degree while traveling along the flow path 20, but may be generally oriented with the front 40 facing in the downstream direction of the flow path 20. The bogie 28 is configured to couple to the ride vehicle 14 after the ride vehicle 14 has travelled the length of the aquatic portion 18 and has arrived at a terminus 36 (e.g., transition area) of the aquatic portion 18. That is, in certain embodiments, the bogie 28 may be positioned at the terminus 36 while the ride vehicle 14 approaches the terminus 36. The ride vehicle 14 may then be positioned onto the bogie 28 to engage with the bogie 28, or vice versa, as discussed in further detail below. In some embodiments, prior to reaching the terminus 36 of the aquatic portion 18, the ride vehicle 14 may be rotated (e.g., approximately 180°) such that the front 40 of the ride vehicle 14 is generally facing upstream of the flow path 20. Particularly, the aquatic portion 18 may include a rotation system 42 (e.g., a turntable) configured to rotate the ride vehicle 14 within the flow path 20. In some embodiments, the rotation system 42 may swirl the water and/or may include a large animatronic that moves the ride vehicle 14 in combination with a show effect to rotate the ride vehicle 14. In this manner, the users, who are facing towards the front 40 of the ride vehicle 14, may be unaware of the bogie 28 positioned downstream of the ride vehicle 14 at the terminus 36 of the aquatic portion 18. This will serve to enhance the thrill factor of the ride system 10 because the transition to the aerial portion 24 of the path 16 will come as a surprise to the users. Once the bogie 28 is engaged (e.g., coupled) with the ride vehicle 14, the bogie 28 may carry the ride vehicle 14 along the aerial portion 24 of the path 16. As the ride vehicle 14 is carried along the track 26 of the aerial portion 24 by the bogie 28, the bogie 28 and the track 26 are configured to cooperatively pitch, yaw, and roll the ride vehicle 14.

After the bogie 28 and the ride vehicle 14 have traveled the length of the aerial portion 24, the bogie 28 may place the ride vehicle 14 in the aquatic portion 18 of the path 16 and disengage with the ride vehicle 14. Particularly, as shown, the bogie 28 may place the ride vehicle 14 at an origin 50 of the aquatic portion 18 such the front 40 of the ride vehicle 14 is facing downstream of the flow path 20. Once the bogie 28 is disengaged from the ride vehicle 14, the ride vehicle 14 may freely float along the flow path 20 to the conveyer 34. Once the ride vehicle 14 has moved beyond the bogie 28, the bogie may move along the track 26 towards the terminus 36 of the aquatic portion 18 to pick up another ride vehicle 14 from the terminus 36, as indicated by arrow 51. In some embodiments, the bogie 28 may pull away from the ride vehicle 14 in a direction that is opposite and parallel to the flow direction of the flow path 20, as indicated by arrow 52. Indeed, in certain embodiments, the bogie 28 may pull away from the ride vehicle 14 faster than the ride vehicle 14 can float away from the bogie 28 in response to currents of the flow path 20. Accordingly, by pulling away from the ride vehicle 14, as opposed to simply allowing the ride vehicle 14 to float away from the bogie 28, the bogie 28 may save time and promptly travel to the terminus 36 of the aquatic portion 18 to pick up another ride vehicle 14.

As discussed herein, operations of the ride system 10 may be controlled utilizing an attraction controller 60. The controller 60 may be any device employing a processor 62 (which may represent one or more processors), such as an application-specific processor. The controller 60 may also include a memory device 64 storing instructions executable by the processor 62 to perform methods and control actions described herein relating to the ride system 10. The processor 62 may include one or more processing devices, and the memory device 64 may include one or more tangible, non-transitory, machine-readable media. By way of example, such machine-readable media can include RAM, ROM, EPROM, EEPROM, CD-ROM, or other optical disk storage, magnetic disk storage or other magnetic storage devices, or any other medium which can be used to carry or store desired program code in the form of machine-executable instructions or data structures and which can be accessed by the processor 62 or by any general purpose or special purpose computer or other machine with a processor. For example, as discussed in further detail below, the attraction controller 60 may be utilized to ensure engagement of the bogie 28 to the ride vehicle 14, ensure disengagement between the ride vehicle 14 and the bogie 28, and determine the rotation, or yaw, of the ride vehicle 14 as the ride vehicle 14 travels along the track 26 of the aerial portion 24. The attraction controller 60 may also monitor and control aspects relating to timing of the ride vehicles 14 as the ride vehicles 14 progress through the ride system 10.

Figure 2:
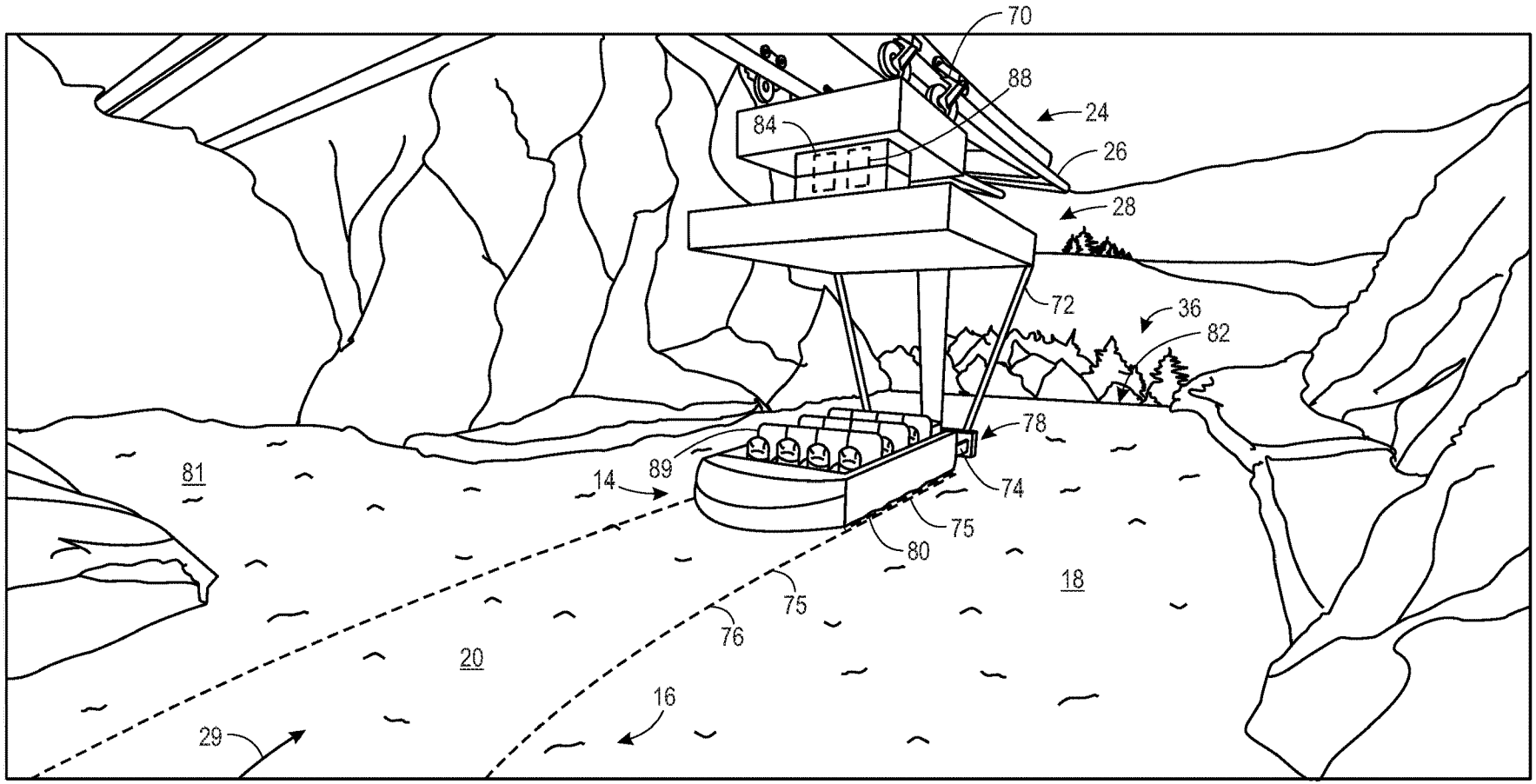
FIG. 2 is a perspective view of an embodiment of a ride vehicle of the ride attraction of FIG. 1, in accordance with the present disclosure.

Keeping this in mind, FIG. 2 is a perspective view of a ride vehicle system 69, which includes the ride vehicle 14 and/or the bogie 28. Particularly, the FIG. 2 shows an embodiment of the ride vehicle 14 engaged with the bogie 28 at the terminus 36 (e.g., transition area) of the aquatic portion 18. As shown, the bogie 28 includes a wheel assembly 70 configured to couple to the track 26. The illustrated bogie 28 also includes an attachment arm 72 extending from the wheel assembly 70 and coupled to the ride vehicle 14 via prongs 74 (e.g., forklift structure, attachment extensions). As shown, the attachment arm 72 may include an overhead structure 79, such as a canopy. The overhead structure 79 may serve to obstruct the users view from the wheel assembly 70 and other elements of the bogie 28, thereby further contributing to an authentic experience of the users. The ride vehicle 14 may be formed of any suitable material configured to contribute to the buoyancy of the ride vehicle 14. Further, it should be noted that the shape of the ride vehicle 14 should not be limited to the illustrated embodiments. For example, in some embodiments, the ride vehicle 14 may be in the shape of a sail boat.

As discussed above, the ride vehicle 14 is configured to float along the flow path 20 of the aquatic portion 18 as indicated by the arrows 29. While moving along the flow path 20, the ride vehicle 14 may be rotated approximately one hundred eighty degrees such that the front 40 of the ride vehicle 14 is facing downstream of the flow path 20. Accordingly, after being rotated, the ride vehicle 14 may approach the bogie 28, which may be located at the terminus 36, in an upstream-facing orientation to couple to the prongs 74 of the bogie 28. The bogie 28 may have arrived at the terminus 36 prior to the ride vehicle 14, having traveled from a second path 81, separate from the path 16. As the ride vehicle 14 approaches the bogie 28, a travel direction of the ride vehicle 14 may be controlled at least in part due to interaction with a positioning system 75, which may include a trough 76 (e.g., channel, conduit, funnel) configured to contact, direct, and center the ride vehicle 14 to a predetermined location 78 to couple to the bogie 28. Specifically, the ride vehicle 14 may include wheels 80, or other friction-reducing elements, coupled to an outer perimeter of the ride vehicle 14 and extending laterally outward from the ride vehicle 14 to interact with walls of the trough 76. In this manner, the wheels 80 of the ride vehicle 14 may interact with the trough 76 to smoothly guide the ride vehicle 14 to the predetermined location 78 and onto the prongs 74. As shown, in certain embodiments, both the trough 76 and the wheels 80 may be completely submerged, or partially submerged, in the water of the flow path 20, so as to obscure the users' view from the trough 76 and the wheels 80.

Once the bogie 28 is engaged with the ride vehicle 14, the bogie 28 may carry the ride vehicle 14 further along the path 16. In some embodiments, the terminus 36 of the aquatic portion 18 and the start of the aerial portion 24 may be adjacent to a waterfall 82. Accordingly, once the bogie 28 is engaged with the ride vehicle 14, the bogie 28 may move the ride vehicle 14 along the track 26 over the waterfall 82 and continue along the aerial portion 24 of the path 16. While the ride vehicle 14 is moving along the aerial portion 24 of the path 16, the ride vehicle 14 is configured to pitch, yaw, and roll. Specifically, the ride vehicle 14 is configured to yaw (e.g., rotate) relative to the wheel assembly 70 that is coupled to the track 26. For example, the wheel assembly 70 may be coupled to the attachment arm 72 via a rotational mechanism 84. The rotational mechanism 84 is configured to rotate or allow rotation of the attachment arm 72 relative to the wheel assembly 70, thereby rotating (e.g., yawing) the ride vehicle 14 while the ride vehicle 14 is coupled to the prongs 74. In some embodiments, the pitch and roll of the ride vehicle 14 may be controlled by the orientation of the track 26. That is, the track 26 may cause the entire bogie 28, along with the ride vehicle 14, to pitch and roll in response to the orientation and curvature of the track 26. However, in some embodiments, the bogie 28 may include a tilt mechanism 88 configured to pitch and/or roll the ride vehicle 14 while the ride vehicle 14 is carried along the track 26. Further, the ride vehicle 14 may have collected water, such as within a seating area 89, as the ride vehicle 14 traveled along the flow path 20. Accordingly, in some embodiments, the bogie 28 may utilize the tilt mechanism 88 to tip (e.g., angle, tilt) the ride vehicle 14 to cause any standing water in the ride vehicle 14 to flow out of the ride vehicle 14, thereby reducing a weight of the ride vehicle 14.

Figure 3:
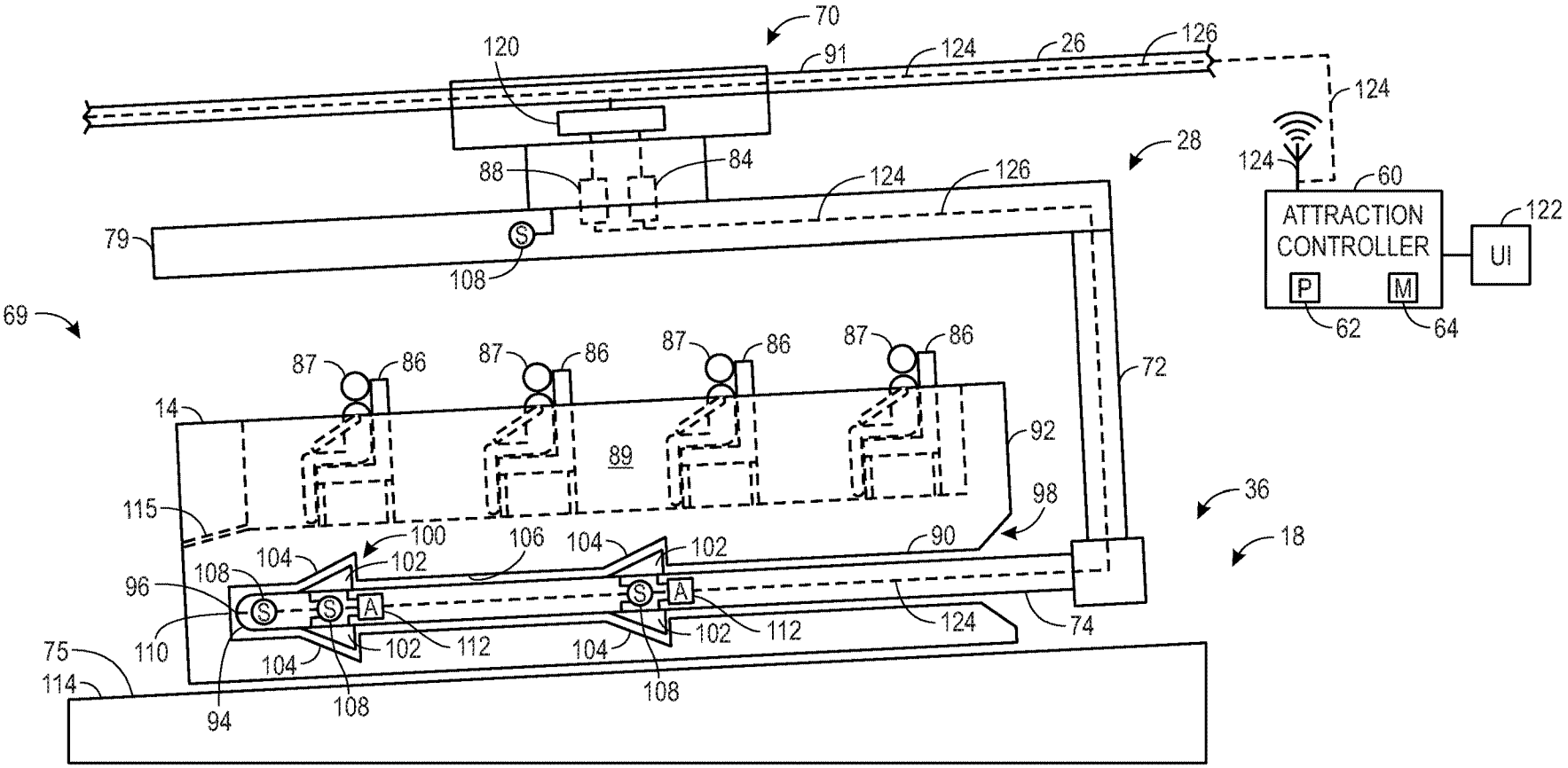
FIG. 3 is a partial side elevation view of an embodiment of a ride vehicle of the ride attraction of FIG. 1, in accordance with the present disclosure.

FIG. 3 is a schematic sectional side elevation view of the bogie 28 engaged with the ride vehicle 14 at the terminus 36 of the aquatic portion 18. As shown, the bogie 28 includes the wheel assembly 70 coupled to the track 26. In some embodiments, the track 26 may include a drive system 91 configured to move the bogie 28 along the track 26. Further, in some embodiments, the bogie 28 may include the drive system 91, which is configured to drive the bogie 28 along the track 26. The bogie 28 also includes the attachment arm 72 extending from the wheel assembly 70 to the prongs 74, which are configured to engage with the ride vehicle 14. The ride vehicle 14 includes one or more seats 86 configured to hold and secure one or more users 87. The ride vehicle 14 further includes a slot 90 extending within a hull 92 (e.g., body, chassis) of the ride vehicle 14. The slot 90 is configured to receive the prongs 74 of the bogie 28. Indeed, in certain embodiments, the slots 90 may extend through a majority of a length of the hull 92 of the ride vehicle 14, and the prongs 74 may be approximately the same length, as illustrated. Moreover, it should be noted that, to focus on certain aspects of the embodiments, the illustration of FIG.

3 has been simplified to only show one slot 90 and one prong 74. However, it is to be understood that the bogie 28 may include one or more prongs 74 and the ride vehicle 14 may include a corresponding number of one or more slots 90 configured to receive the one or more prongs 74.

The prong 74 may include a tapered (e.g., rounded, pointed) tip 94 disposed on a distal end 96 of the prong 74. The slot 90 may similarly include a flared orifice 98 configured to receive the prong 74. In this manner, the distal end 96 of the prong 74 may easily be inserted into the flared orifice 98 of the slot 90. For example, similar in functionality to a funnel, the flared geometry of the flared orifice 98 and the tapered geometry of the tapered tip 94 serve to guide the distal end 96 of the prong 74 into the slot 90 if the prong 74 is not perfectly aligned with the slot 90 during insertion of the prong 74. Further, as shown, the flared orifice 98 of the slot 90 may be disposed at a rear of the ride vehicle 14. The flared orifice 98 may also be relatively small in comparison to a size of the ride vehicle 14. In this manner, the users 87 may be ignorant of the presence and/or purpose of the slot 90, which may further add to the thrill factor of being surprised by the engagement of the bogie 28. Once the prong 74 is inserted into the slot, the bogie 28 may passively engage with the ride vehicle 14 utilizing a locking system 100.

Generally, the locking system 100 is configured to prevent the prong 74 from moving out of the slot 90 once the prong 74 inserted into the slot 90. To this end, the locking system 100 may include one or more pawls 102 coupled to the prong 74. The locking system 100 also includes one or more recesses 104 disposed within an internal wall 106 of the slot 90. The pawls 102 are biased outwardly from the prong 74 such that pawls 102 are configured to retract against the internal wall 106 and extend into the recesses 104 as the prong is inserted into the slot 90. Further, the pawls 102 are configured to interface with the recesses 104 to prevent the prong 74 from being moved out of the slot 90. In some embodiments, the pawls 102 may be outwardly biased toward the recesses via spring mechanisms.

The locking system 100 further includes one or more sensors 108 configured to detect (e.g., determine) a position of the pawls 102. For example, an extended position of the pawls 102 may indicate that the bogie 28 is coupled to the ride vehicle 14. That is, if the pawls 102 are outwardly extended, this may indicate that the pawls 102 are disposed within the recesses 104. Similarly, a retracted position of the pawls 102 may indicate that the bogie 28 is not engaged with the ride vehicle 14. That is, if the pawls 102 are inwardly retracted, this may indicate that the pawls 102 are not disposed within the recesses 104. In some embodiments, the one or more sensors 108 may be configured to determine a distance to which the prong 74 is inserted into the slot 90. For example, the one or more sensors 108 include proximity sensors configured to detect a distance between the distal end 96 of the prong 74 and a back wall 110 of the slot 90. In some embodiments, the controller 60 may determine that the bogie 28 is engaged with the ride vehicle 14 if the sensors 108 detect that the pawls 102 move from an extended position (while disposed external to the slot 90) to a retracted position (while the prong 74 is being inserted into the slot 90), and back to the extended position (when the pawls 102 are disposed within the recesses 104).

The locking system 100 may further include one or more actuators 112 configured to disengage the bogie 28 from the ride vehicle 14. Particularly, the actuators 112 are configured to overcome the outward bias of the pawls 102 to retract the pawls 102. Once the pawls 102 are in the retracted position, the prong 74 may be pulled out of the slot 90, and the bogie 28 may be disengaged from the ride vehicle 14. In this manner, the prong 74 is configured to passively engage (e.g., via the biased pawls 102) with the ride vehicle 14 and may actively disengage (e.g., via the actuators 112) from the ride vehicle 14. Indeed, the prong 74 may utilize any suitable passive connection system or method to engage with the ride vehicle 14 and may utilize any suitable active (e.g., powered) system to disengage with the ride vehicle 14.

Moreover, as discussed above, the ride vehicle 14 may be pitched to drain the ride vehicle 14 of any residual water that may have accumulated in the seating area 89 as the ride vehicle 14 travels through the aquatic portion 18 of the path 16. In some embodiments, the ride vehicle 14 may be pitched utilizing the tilt mechanism 88, as discussed above. In some embodiments, the ride vehicle 14 may be pitched utilizing an inclined surface 114, or ramp, of the positioning system 75, which may utilize a conveyer mechanism. For example, prior to engagement with the bogie 28, the ride vehicle 14 may travel onto the inclined surface 114, which may be located within the trough 76. As the ride vehicle 14 moves onto the inclined surface 114, the ride vehicle 14 may be disposed at an inclined angle. In this manner, liquid disposed within the ride vehicle 14 may flow out of the ride vehicle 14, such as through a drain 115. In certain embodiments, the ride vehicle 14 may similarly be positioned at a declined angle to drain liquid through a rear of the ride vehicle 14, such as through a drain. Moreover, in some embodiments, the inclined position of the ride vehicle 14 while disposed on the inclined surface 114 may prevent the ride vehicle 14 from moving to the aerial portion 24 of the path 16 if the ride vehicle 14 is not adequately engaged with the bogie 28. To illustrate, prior to engagement with the bogie 28, the ride vehicle 14 may be disposed at an angle on the inclined surface 114, as shown. The prong 74 of the bogie 28 may then insert into the slot 90 of the ride vehicle 14 at a similar angle. Once inserted into the ride vehicle 14, the bogie 28 may attempt to lift the ride vehicle 14 by pulling in a direction parallel to the angle of the slot 90. In this manner, if the prong 74 is not adequately engaged with the ride vehicle 14, the ride vehicle 14 may simply slip off of the prong 74 and remain on the inclined surface 114 while the bogie 28 pulls away. In some embodiments, the angle at which the bogie 28 pulls away from the slot 90 may be due to the track 26 being at a corresponding angle as the bogie 28 moves along the track 26. In some embodiments, the angle may be approximately between 10° and 45°, or any other suitable angle.

Further, as discussed above, the attachment arm 72 and the ride vehicle 14 are configured to be rotated (e.g., yawed) relative to the wheel assembly 70 of the bogie 28. To this end, the bogie 28 may include the rotational mechanism 84 (e.g., motor) configured to cause the attachment arm 72 to rotate relative to the wheel assembly 70. Further, the one or more sensors 108 of the bogie 28 may include a proximity sensor configured to detect the angular position of the attachment arm 72 relative to the wheel assembly 70. As discussed below, in certain embodiments, the rotational mechanism 84 may be controlled to rotate the attachment arm 72 to a desired position based on the measured angular position from the proximity sensor of the one or more sensors 108.

In some embodiments, one or more operations of the bogie may be controlled by a bogie controller 120. Indeed, the one or more sensors 108, the actuators 112, the rotational mechanism 84, and the tilt mechanism 88 may be communicatively coupled to the bogie controller 120. Particularly, as discussed in further detail below, the bogie controller 120 may utilize data acquired from the one or more sensors 108 to control operations of the actuators 112, the rotational mechanism 84, and the tilt mechanism 88. Indeed, in certain embodiments, each bogie 28 of the ride system 10 may include the bogie controller 120. To this end, each bogie controller 120 of the bogies 28 of the ride system 10 may be communicatively coupled to the attraction controller 60 to communicate data indicative of each respective bogie 28 to the attraction controller 60. The attraction controller 60 may also utilize the data acquired from each respective bogie controller 120 to provide relevant ride vehicle information to an attraction operator, such as through a user interface 122. Relevant ride vehicle information may include, for example, whether the bogie 28 is engaged with the ride vehicle 14, a location of the bogie 28 along the path 16, a health status of the bogie 28, and so forth.

To this end, the one or more sensors 108, the actuators 112, the rotational mechanism 84, the tilt mechanism 88, the bogie controller 120, and the attraction controller 60 may be communicatively coupled via a communication system 124. In some embodiments, the communication system 124 may communicate through a wireless network, such as wireless local area networks [WLAN], wireless wide area networks [WWAN], near field communication [NFC], or Bluetooth. Additionally or alternatively, the communication system 124 may communicate through a wired network such as local area networks [LAN], or wide area networks [WAN]. For example, in some embodiments, the communication system 124 may include a conductive medium 126 communicatively coupling the sensors 108, actuators 112, the tilt mechanism 88, and rotational mechanism 84 to the bogie controller 120. The communication system 124 may include a bus bar coupled to the track 26 configured to facilitate communication between the bogie 28 (e.g., the bogie controller 120) and the attraction controller 60. For example, the wheel assembly 70 of the bogie 28 may include one or more brushes (e.g., carbon brushes) that may electrically couple the bogie 28 (e.g., the bogie controller 120) and the attraction controller 60. Moreover, in certain embodiments, the ride system 10 may include a single controller (e.g., the attraction controller 60), which may include the functionality of both the bogie controller 120 and the attraction controller 60, as described above.

Figure 4:
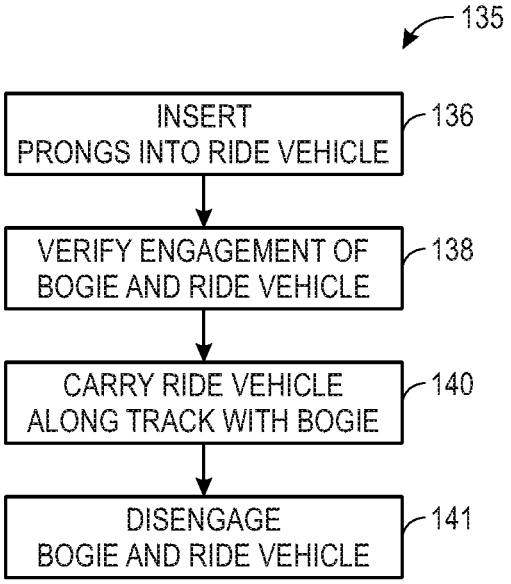
FIG. 4 is a flow diagram of an embodiment of a process of operating a ride attraction having multiple transportation modes, in accordance with the present disclosure.

FIG. 4 is a flow diagram of a process 135 for engagement and disengagement of the bogie 28 with the ride vehicle 14. First, it should be noted that the following discussion of FIG. 4 may refer to elements illustrated in FIG. 3.

At block 136, the prongs 74 of the bogie 28 may be inserted into the slots 90 of the ride vehicle 14. Particularly, as discussed above, the bogie 28 may be stationary, and the ride vehicle 14 may move onto the prongs 74. In some embodiments, however, the bogie 28, the ride vehicle 14, or both may be mobile during the acts represented by block 136. As the prongs 74 are inserted into the slots 90, the prongs 74 may passively engage with ride vehicle 14 via the pawls 102 and corresponding recesses 104, as discussed above. Also as mentioned above, the ride vehicle 14 may engage with the bogie 28 at an inclined angle, thereby ensuring proper engagement and draining the ride vehicle 14 of excess water.

At block 138, a controller (e.g., the attraction controller 60, the bogie controller 120, or both) may verify engagement of the bogie 28 and the ride vehicle 14. Particularly, the one or more sensors 108 may gather data indicative of a level of engagement of the prong 74 with the slot 90, and may send the data to the controller. The controller may analyze the data and determine the level of engagement based on the data. In some embodiments, the level of engagement may be based on a measured angular position of the pawls 102 of the prongs 74. That is, if the pawls 102 are angled outward, away from the prong 74, this may indicate that the pawls 102 are disposed within the recesses 104, which would prevent the prong 74 from pulling out of the slot 90 and would indicate sufficient engagement. Moreover, in certain embodiments, the bogie 28 may apply a force to pull out of the slot 90, and the one or more sensors 108 may be configured to measure the force. For example, to measure the force, the one or more sensors 108 may measure a pressure the pawl 102 applies to a surface of the recess 104. If the force if above a predetermined threshold level, the controller may determine that the bogie 28 is adequately engaged with the ride vehicle 14. In some embodiments, the controller may determine that the bogie 28 is not adequately engaged with the ride vehicle 14. In such embodiments, the controller may cause the ride system 10 to discontinue operation. In other embodiments, if the controller determines that the ride vehicle 14 is disposed on the prongs 74, but is not engaged with the prongs 74, the controller may send one or more signals to the bogie 28 to cause the bogie 28 to push the ride vehicle 14 to an auxiliary location, separate from the path 16.

At block 140, once the controller has verified/determined that the ride vehicle 14 and the bogie 28 are adequately engaged, the bogie 28 may carry the ride vehicle 14 along the aerial portion 24 of the track 26. While carrying the ride vehicle 14 along the track 26, the bogie 28 is configured to cause the ride vehicle 14 to rotate, or yaw, relative to the wheel assembly 70. Particularly, the rotational mechanism 84, which extends between the wheel assembly 70 and the attachment arm 72, is configured to cause the ride vehicle 14 to rotate in response to input from the controller. As the bogie 28 approaches the end of the aerial portion 24 of the path 16 (e.g., the origin 50 of the aquatic portion 18), the one or more sensors 108 may gather data indicative of an angular position of the attachment arm 72 and ride vehicle 14. The one or more sensors 108 may send this data to the controller. The controller may analyze this data and send one or more signals to the rotational mechanism 84 to cause the rotational mechanism 84 to rotate the attachment arm 72 to center the ride vehicle 14. As used herein, centering the ride vehicle 14 may refer to rotating the ride vehicle 14 to a desired angular position, which may depend a design of the ride system 10. That is, in some embodiments, a centered position of the ride vehicle 14 may be such that the front 40 of the ride vehicle 14 is facing a direction parallel to a direction of the path 16, or a direction of movement of the ride vehicle 14. In some embodiments, the centered position of the ride vehicle 14 may refer to the front 40 of the ride vehicle 14 facing a dispatch direction, or a direction of the flow path 20 of the aquatic portion 18.

At block 141, the bogie 28 may place the ride vehicle 14 in the aquatic portion 18 of the path 16 and disengage from the ride vehicle 14. Particularly, as discussed briefly above, the controller may send one or more signals to the actuators 112 to cause the pawls 102 to retract toward the prong 74, thereby disengaging the bogie 28 from the ride vehicle 14. Once the ride vehicle 14 is disengaged from the bogie 28, the ride vehicle 14 may move along the flow path 20 of the aquatic portion 18 in response to the water current of the flow path 20. In some embodiments, the bogie 28 may pull away from the ride vehicle 14, as discussed above. Once the prongs 74 of the bogie 28 are disposed external to the ride vehicle 14, the bogie 28 may travel to the terminus 36 to engage with another ride vehicle 14.

Figure 5:
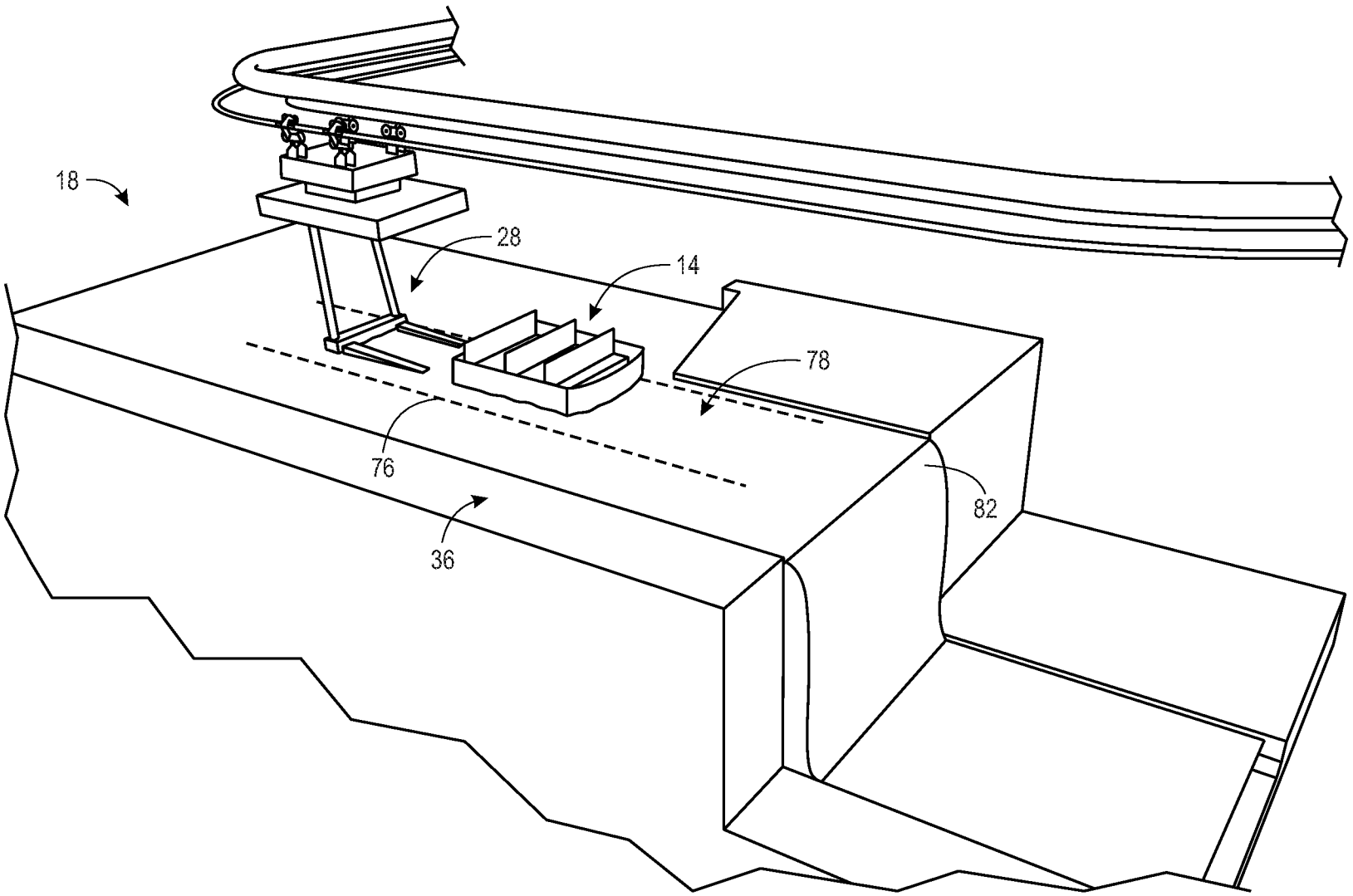
FIG. 5 is a perspective view of an embodiment of a ride vehicle of the ride attraction of FIG. 1 in a process of engaging with a bogie, in accordance with the present disclosure.

FIG. 5 is a perspective view an embodiment of the ride vehicle 14 as it approaches the terminus 36 of the aquatic portion 18. Indeed, the terminus 36 of the aquatic portion 18 may be defined by an area of the flow path 20 adjacent to the waterfall 82 or another similar feature (e.g., a cliff, a ditch). In the current embodiment, the ride vehicle 14 may approach the terminus 36 of the aquatic portion 18 with the front 40 of the ride vehicle 14 facing the waterfall 82. In this manner, the users disposed within the ride vehicle 14 may see the waterfall 82 and experience excitement, which serves to enhance a thrill factor of the ride system 10. In the illustrated embodiment, the bogie 28 may approach the ride vehicle 14 from the rear of the ride vehicle 14, as shown. In this manner, the users may be unaware that the ride vehicle 14 is about to be coupled to and lifted by the bogie 28. Indeed, similar to embodiments discussed above, the ride vehicle 14 may be controlled in part by the trough 76 configured to guide the ride vehicle 14 to the predetermined location 78 in which the bogie 28 may engage to the ride vehicle 14.

Figure 6:
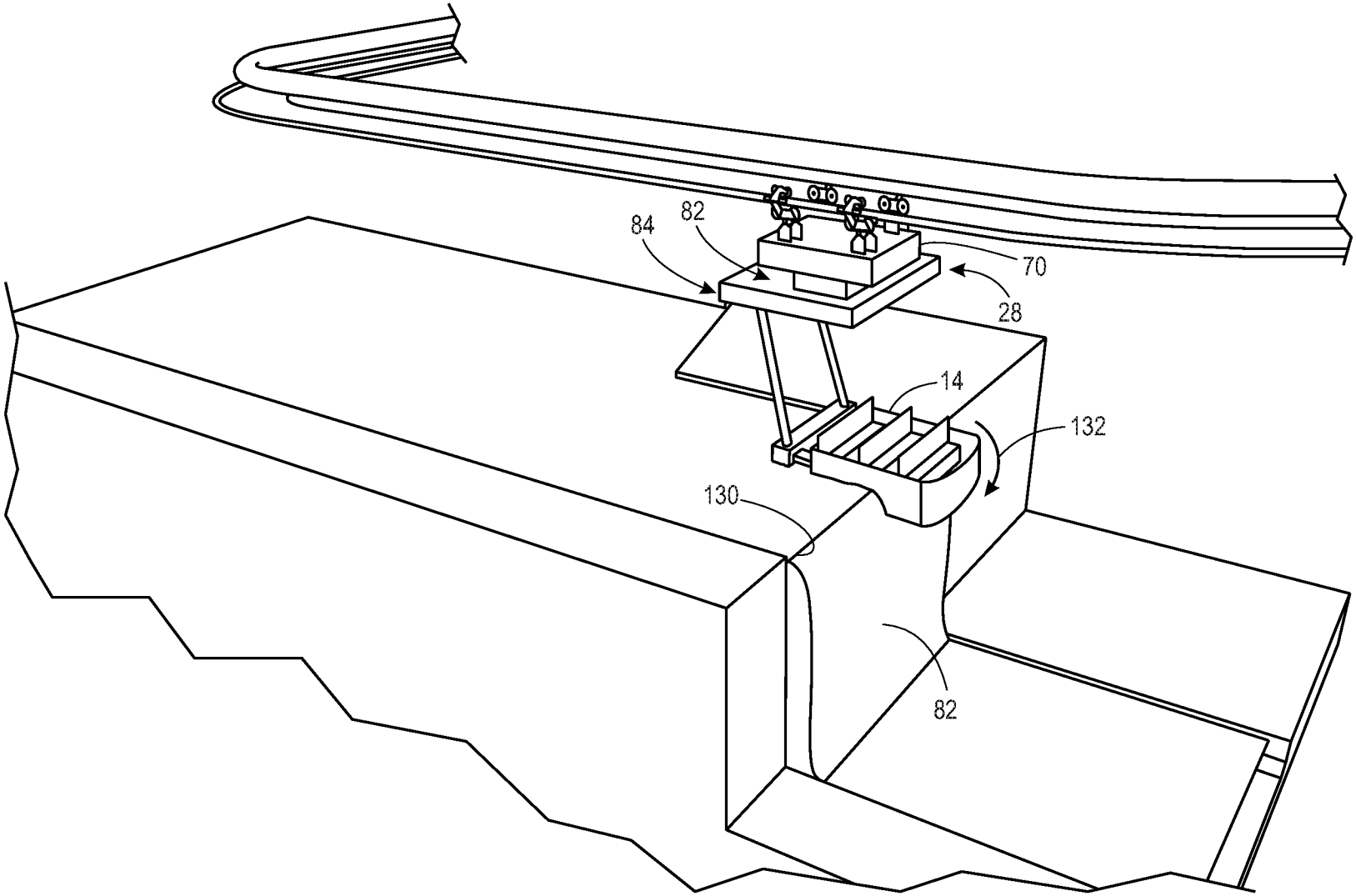
FIG. 6 is a perspective view of an embodiment of the ride vehicle of FIG. 5 in a process of transitioning between riding formats, in accordance with the present disclosure.

FIG. 6 is a perspective view of an embodiment of the ride vehicle 14 once the ride vehicle 14 has been coupled to the bogie 28. As shown, in certain embodiments, the bogie 28 may guide the ride vehicle 14 to a stagnant position at the waterfall 82 for a period of time. In the illustrated embodiment, the bogie 28 may couple to the ride vehicle 14 prior to approaching the waterfall 82, engage with the ride vehicle 14, and then hold the ride vehicle 14 at the waterfall 82 with a portion of the ride vehicle 14 extending over an edge 130 of the waterfall 82. In this manner, the users may feel as though the ride vehicle 14 is about to fall down the waterfall 82. As discussed above, the bogie 28 is configured to yaw and pitch the ride vehicle 14. In some embodiments, the bogie 28 is configured to pitch the ride vehicle 14 forward over the waterfall 82, as indicated by arrow 132. In this manner, the ride vehicle 14 may be drained of any water disposed within the ride vehicle 14, thereby reducing a weight of the ride vehicle 14. Particularly, the bogie 28 is configured to pitch the ride vehicle 14 forward via the tilt mechanism 88 configured to adjust an angular position of the ride vehicle 14 relative to the wheel assembly 70 disposed above the ride vehicle 14. The bogie 28 also includes the rotational mechanism 84 configured to rotate, or yaw, the ride vehicle 14 relative to the wheel assembly 70, as discussed above. Once the ride vehicle 14 has been engaged with the bogie 28, the bogie 28 may lift the ride vehicle 14 from the aquatic portion 18 of the path 16, and continue along the aerial portion 24 of the path 16. The bogie 28 may then place the ride vehicle 14 in the origin 50 of flow path 20 once the ride vehicle 14 has traveled the length of the aerial portion 24.

Figure 7:
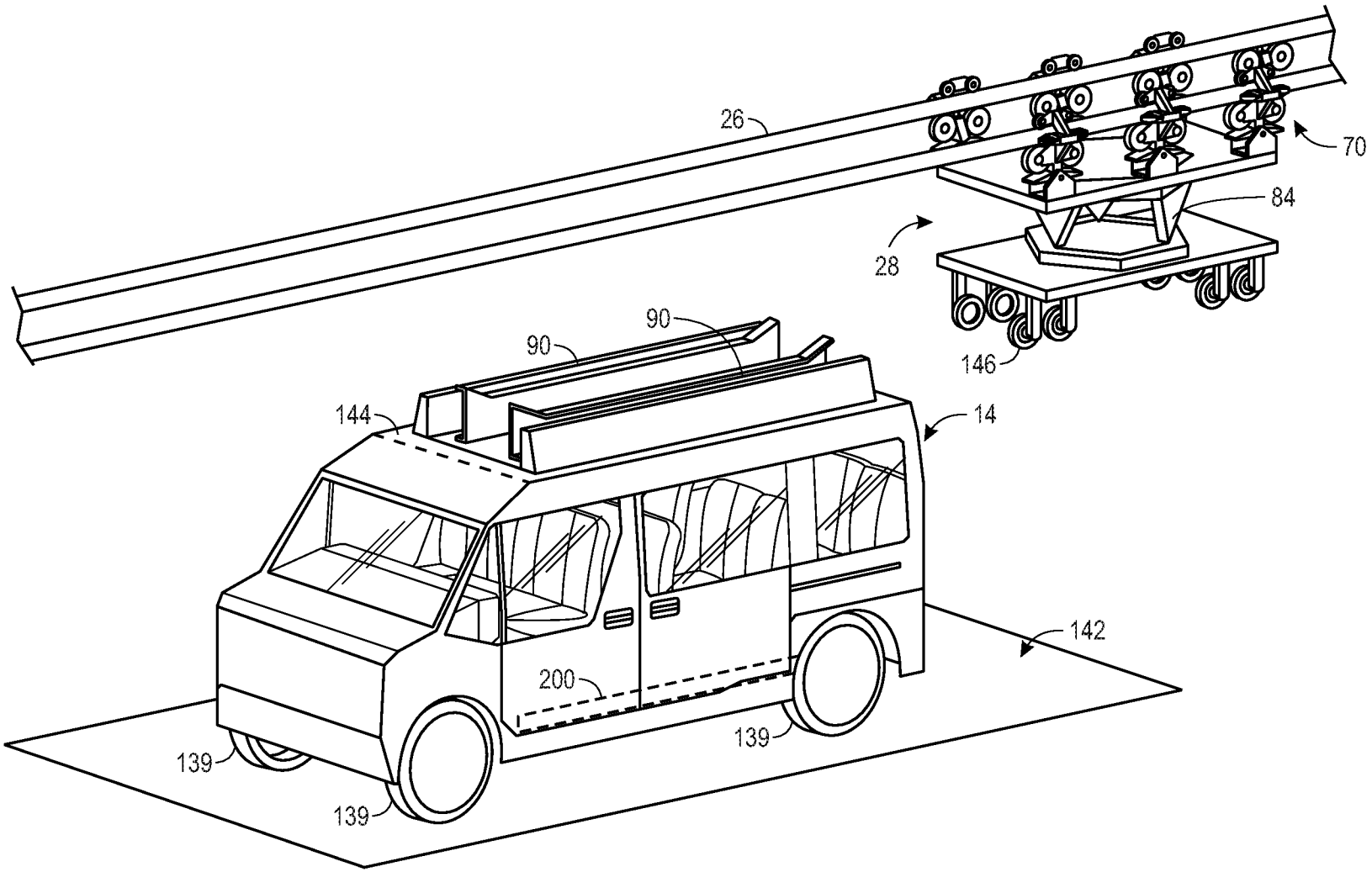
FIG. 7 is a perspective view of an embodiment of a ride vehicle and a bogie of the ride attraction of FIG. 1 prior to engagement with each other, in accordance with the present disclosure.

Additionally, the ride vehicle 14 may be configured to move along various terrain. For example, as shown in FIG. 7, the ride vehicle 14 may include drive wheels 139 configured to move over various terrain, such as concrete, grass, dirt, and so forth, similar to an automobile. Indeed, the ride system 10 may include a terrestrial portion 142 of the path 16 on which the ride vehicle 14 is configured to move. In this respect, as discussed herein, the ride vehicle 14 may be configured to travel along various geographic paths, such as the terrestrial portion 142 and/or the aquatic portion 18. The terrestrial portion 142 of the path 16 may be in addition to, or in place of, the aquatic portion 18 and/or the aerial portion 24 of the path 16. The ride vehicle 14 is configured to couple to the bogie 28 via the slots 90 (e.g., guide rails) disposed on a roof 144 of the ride vehicle 14. The slots 90 are configured to receive and couple to a set of engagement wheels 146 of the bogie 28. That is, the bogie 28 is configured to move along the track 26 via the wheel assembly 70 to insert the engagement wheels 146 into the slots 90. As discussed in further detail below, once the engagement wheels 146 are disposed within the slots 90, the slots 90 are configured to engage with the engagement wheels 146.

Figure 8:
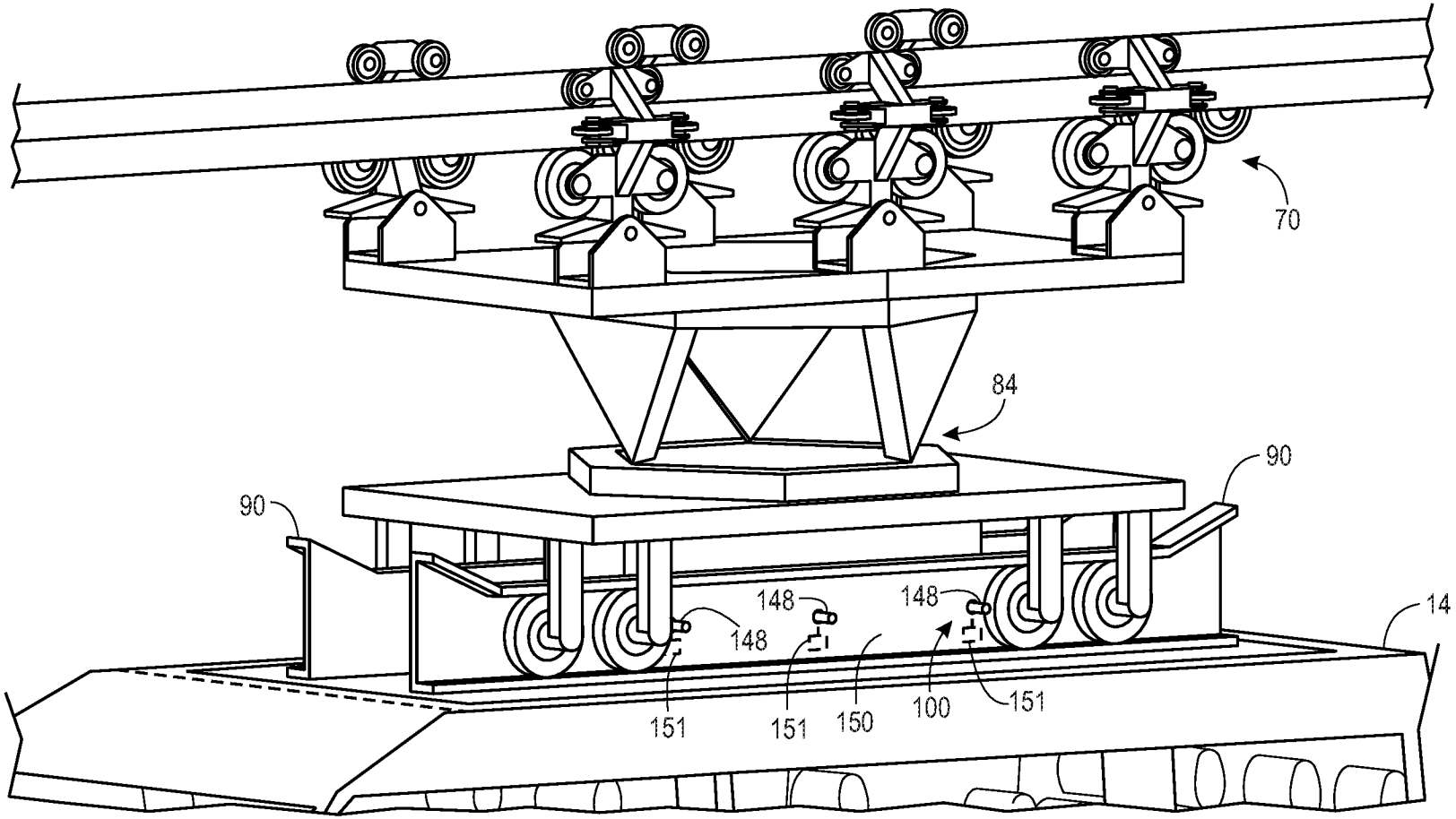
FIG. 8 is a perspective view of an embodiment of the ride vehicle and the bogie of FIG. 7 while engaged with each other, in accordance with the present disclosure.

For example, FIG. 8 is perspective view of a top portion of the ride vehicle 14. In the illustrated embodiment, a portion of the slots 90 has been removed to highlight the locking system 100 of the slots 90. The locking system 100 may include one or more locking pins 148 extending from an inner wall 150 of the slots 90 to engage the ride vehicle 14 with the bogie 28. For example, as discussed above, the engagement wheels 146 may be translated into the slots 90. Once the engagement wheels 146 are disposed within the slots 90, the locking pins 148 may extend laterally away from the inner wall 150 (e.g., via actuators 151). The extended disposition of the locking pins 148 may ensure that the engagement wheels 146 are held within the slot 90, as shown. During disengagement, the locking pins 148 may retract into the inner wall 150 of the slot 90 (e.g., via the actuators 151). Once the locking pins 148 are retracted into the inner wall 150, the bogie 28 is allowed to translate out of engagement with the slots 90. Further, as shown, the ride vehicle 14 may include the rotational mechanism 84 configured to rotate engagement wheels 146 and the ride vehicle 14 relative to the wheel assembly 70.

In some embodiments, the ride vehicle 14 may be configured to travel outside of the path 16. For example, the ride vehicle 14 may be configured to transport users throughout the amusement park 12, such as between attractions, hotels, parking lots, shops, and so forth. In such embodiments, the ride vehicle 14 may be configured to couple to the bogie 28 and the bogie 28 is configured to carry the ride vehicle 14 over portions of the amusement park 12 so as to avoid foot traffic, for example. Moreover, in certain embodiments, the ride vehicle 14 may be configured to transition between the terrestrial portion 142 of the path 16 and the aquatic portion 18 of the path 16. To this end, the ride vehicle 14 may include the drive wheels 139. Additionally or alternatively, the ride vehicle 14 may include a flotation system 200 (shown in FIG. 7) that enables the ride vehicle 14 to freely float along the aquatic portion 18. The flotation system 200 may include one or more materials/elements (e.g., air-filled elements) configured to provide a buoyant force to the vehicle 14 when the ride vehicle 14 is disposed within the aquatic portion 18.

Figure 9:
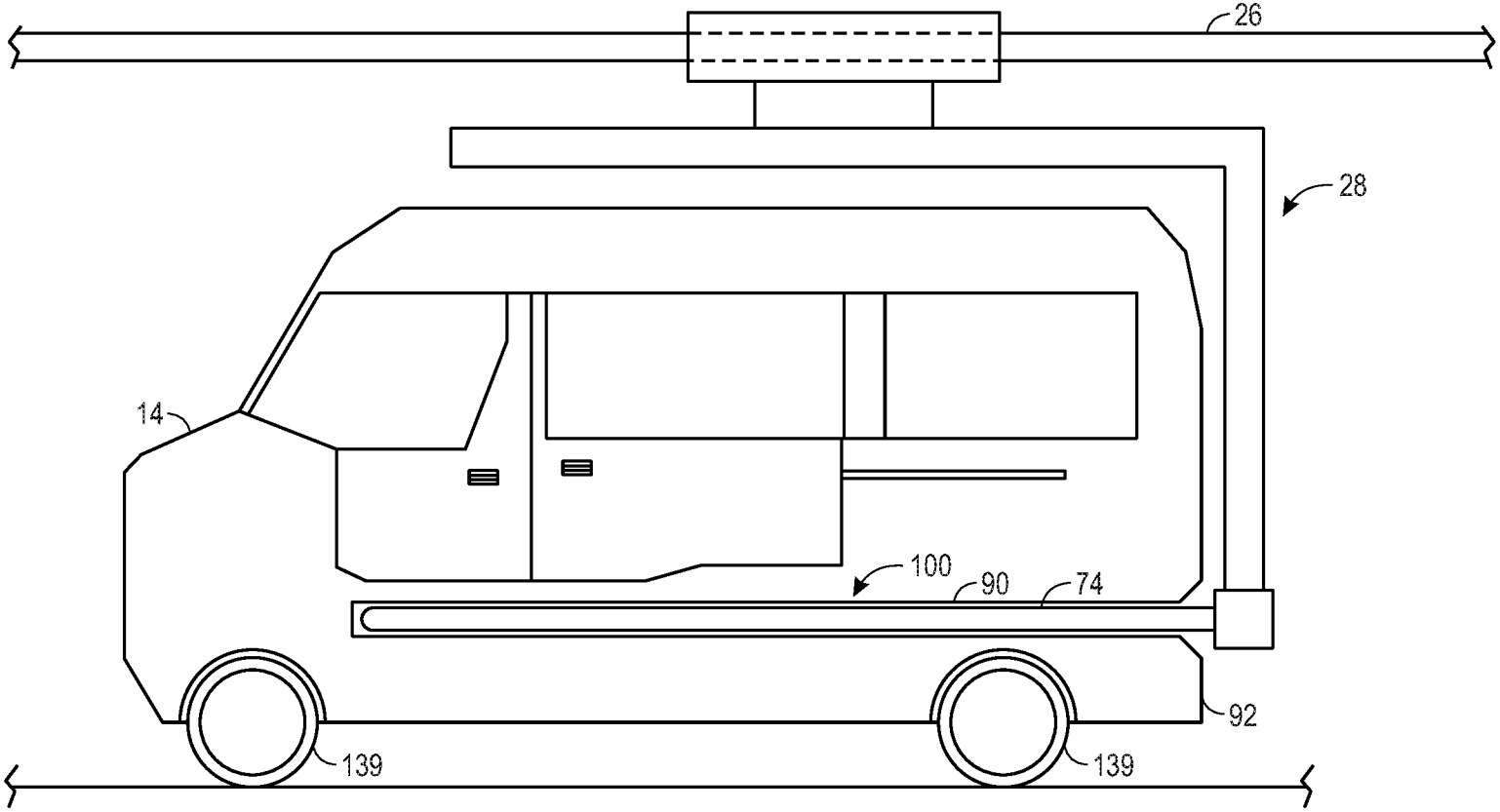
FIG. 9 is a side elevation view of an embodiment of the ride vehicle of the ride attraction of FIG. 1, in accordance with the present disclosure.

In some embodiments, the ride vehicle 14, as illustrated in FIGS. 7 and 8, may be configured to couple to the bogie 28 via slots extending through the hull 92 of the ride vehicle 14. For example, as shown in FIG. 9, the ride vehicle 14 may be configured to move over various terrain via the drive wheels 139, as described above, and may also be configured to engage with the bogie 28 via prongs 74 of the bogie 14, as described above in FIG. 3. Indeed, it should be noted that the illustrated embodiment of FIG. 9 has been intentionally simplified to highlight certain aspects of the ride vehicle 14. Accordingly, it is to be understood that the ride vehicle 14 and the bogie 28 may include additional elements that are discussed herein, but are not explicitly illustrated in FIG. 9. For example, the ride vehicle 14 in the illustrated embodiment may include the slot 90, which may include all of the features of the slot 90 described above in reference to FIG. 3. Further, the bogie 28 may be configured to couple to (e.g., engage with) the slot 90 via the prongs 74, as also described above in reference to FIG. 3. Accordingly, the bogie 28 is configured to travel along the track 26, engage with the ride vehicle 14, carry the ride vehicle 14 along the track 26, and disengage from the ride vehicle 14, as discussed herein. Generally, it is to be understood that the embodiments of the ride vehicle 14 and bogie 28, as illustrated in FIGS. 1-9, may be combined in any suitable manner.

While only certain embodiments have been illustrated and described herein, many modifications and changes will occur to those skilled in the art. It is, therefore, to be understood that the appended claims are intended to cover all such modifications and changes as fall within the true spirit of the invention.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . " it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. An amusement park system, comprising:

a ride vehicle configured to move along a path;

an aquatic portion of the path defined by a water flow path, wherein the aquatic portion of the path comprises a positioning system disposed at a terminus of the aquatic portion, and wherein the positioning system comprises a conveyer configured to support the ride vehicle and position the ride vehicle on an incline of the terminus of the aquatic portion; and an aerial portion of the path defined by a track configured to support a bogie, wherein the ride vehicle is configured to freely float and move along the water flow path in response to currents of the water flow path, and wherein the bogie is configured to couple with the ride vehicle positioned on the incline of the terminus of the aquatic portion and carry the ride vehicle beyond the aquatic portion along the track.

2. The amusement park system of claim 1, wherein the positioning system comprises a trough configured to contact the ride vehicle to guide the ride vehicle to the terminus.

3. The amusement park system of claim 1, wherein the aquatic portion of the path comprises a waterfall disposed adjacent to the terminus of the aquatic portion.

4. The amusement park system of claim 1, wherein the conveyer comprises an angled surface configured to support the ride vehicle at an angle relative to a horizontal plane at the terminus to drain liquid from the ride vehicle.

5. The amusement park system of claim 1, wherein the aquatic portion comprises a rotation system configured to rotate the ride vehicle relative to the water flow path such that a front of the ride vehicle faces upstream relative to the water flow path.

6. The amusement park system of claim 1, comprising the bogie, wherein the bogie comprises a wheel assembly configured to couple to the track, and wherein the bogie comprises a prong configured to couple to the ride vehicle.

7. The amusement park system of claim 6, wherein the bogie comprises a rotational mechanism configured to rotate the prong relative to the wheel assembly.

8. A ride vehicle system, comprising:

a ride vehicle comprising a slot disposed internal to a hull of the ride vehicle and configured to freely float on a liquid along a flow path; and a bogie configured to move along a track, wherein the bogie comprises a prong configured to extend into the slot and engage with the slot to couple the bogie to the ride vehicle, and wherein the prong is configured to engage with an inner wall of the slot via an attachment mechanism upon insertion of the prong into the slot.

9. The ride vehicle system of claim 8, wherein the attachment mechanism of the prong comprises a pawl, and wherein the pawl is configured to engage with a recess upon insertion of the prong into the slot to couple the bogie to the ride vehicle.

10. The ride vehicle system of claim 9, wherein the prong comprises an actuator coupled to the pawl, and wherein the actuator is configured to retract the pawl to thereby withdraw the pawl from the recess to disengage the prong from the slot.

11. The ride vehicle system of claim 8, wherein the bogie comprises a tilt mechanism configured to pitch the ride vehicle while the ride vehicle is coupled to the bogie.

12. The ride vehicle system of claim 8, further comprising a sensor configured to detect a level of engagement of the bogie with the ride vehicle.

13. The ride vehicle system of claim 8, further comprising the track, wherein the track or the bogie comprises a drive system configured to drive the bogie along the track.

14. The ride vehicle system of claim 8, wherein the flow path comprises a rotation system configured to rotate the ride vehicle relative to the flow path such that a front of the ride vehicle faces upstream relative to the flow path.

15. The ride vehicle system of claim 8, wherein the flow path comprises a waterfall disposed adjacent to a terminus of the flow path.

16. An amusement park system, comprising:

a ride vehicle configured to travel along a geographic path, wherein the ride vehicle comprises slots integrated with a roof of the ride vehicle; and a bogie, wherein the bogie comprises engagement wheels configured to couple to the slots of the ride vehicle, and wherein the bogie is configured to travel along a track, engage with the ride vehicle, carry the ride vehicle along the track, and disengage from the ride vehicle.

17. The amusement park system of claim 16, wherein the geographic path comprises a liquid flow path defined by a flume, and wherein the ride vehicle is configured to float along the liquid flow path.

18. The amusement park system of claim 17, wherein the liquid flow path comprises a waterfall disposed adjacent to a terminus of the liquid flow path.

19. The amusement park system of claim 16, wherein the geographic path comprises a terrestrial path, and wherein the ride vehicle is configured to drive along the terrestrial path.

20. The amusement park system of claim 16, wherein the slots comprise locking pins coupled to inner walls of the slots, wherein the locking pins are configured to extend from the inner walls of the slots to lock the engagement wheels to the slots, and wherein the locking pins are configured to retract into the inner walls to unlock the engagement wheels from the slots.

21. The amusement park system of claim 16, wherein the geographic path comprises a terrestrial path and a liquid flow path, wherein the ride vehicle comprises drive wheels configured to drive the ride vehicle along the terrestrial path, wherein the ride vehicle comprises a flotation system configured to provide a buoyant force for the ride vehicle to freely float along liquid of the liquid flow path, and wherein the ride vehicle is configured to transition between the terrestrial path and the liquid flow path.

22. The amusement park system of claim 16, comprising an aquatic portion of the geographical path defined by a water flow path, wherein the aquatic portion of the geographical path comprises a positioning system disposed at a terminus of the aquatic portion, and wherein the positioning system comprises a conveyer configured to support the ride vehicle and position the ride vehicle at an inclined portion of the water flow path comprising the terminus of the aquatic portion.

23. The amusement park system of claim 16, wherein the bogie comprises a tilt mechanism configured to pitch the ride vehicle while the ride vehicle is coupled to the bogie.

* * * * *